United States Patent [19]

Super

[11] Patent Number: 4,773,116

[45] Date of Patent: Sep. 27, 1988

[54] CHIMNEY CLEANING DEVICE

[76] Inventor: Richard A. Super, 83 State Rte. 42, West Salem, Ohio 44287

[21] Appl. No.: 96,060

[22] Filed: Sep. 14, 1987

[51] Int. Cl.[4] ..... F23J 3/00

[52] U.S. Cl. ..... 15/249; 15/163

[58] Field of Search ..... 15/160, 162, 163, 242, 15/243, 104.03, 104.05, 104.16, 104.17, 104.18, 104.19, 104.20, 249; D32/14, 19; D4/121, 127, 128; 98/46; 126/16; 166/170, 175

[56] References Cited

U.S. PATENT DOCUMENTS

| | | | |
|---|---|---|---|
| 2,284,391 | 5/1942 | Hefle | 15/163 |
| 3,007,616 | 11/1961 | Zuckerman | 223/89 |
| 4,208,756 | 6/1980 | Smith | 15/243 |
| 4,208,757 | 6/1980 | Baugh et al. | 15/249 |
| 4,252,456 | 2/1981 | Kallaes et al. | 403/110 |
| 4,340,989 | 7/1982 | Rotondi et al. | 15/163 |
| 4,505,000 | 3/1985 | Boehland et al. | 15/163 |
| 4,538,317 | 9/1985 | Sorensen | 15/243 |

FOREIGN PATENT DOCUMENTS

| | | | |
|---|---|---|---|
| 2221436 | 11/1973 | Fed. Rep. of Germany | 15/163 |
| 1349810 | 12/1963 | France | 15/163 |

*Primary Examiner*—Harvey C. Hornsby
*Assistant Examiner*—Joseph S. Machuga
*Attorney, Agent, or Firm*—Renner, Kenner, Greive, Bobak, Taylor & Weber

[57] ABSTRACT

A chimney cleaning device is disclosed comprising a crown assembly and a base assembly, respectively mounted at the top and the bottom of a chimney flue. The assemblies contain a system of pulleys over which a brush connected cable loop is disposed. One of the bottom pulleys is connected to, and driven by a crank which when rotated, causes the brush to go up or down the chimney flue, dislodging soot and other unwanted accumulations therefrom, thereby cleaning the chimney.

10 Claims, 2 Drawing Sheets

FIG.-1
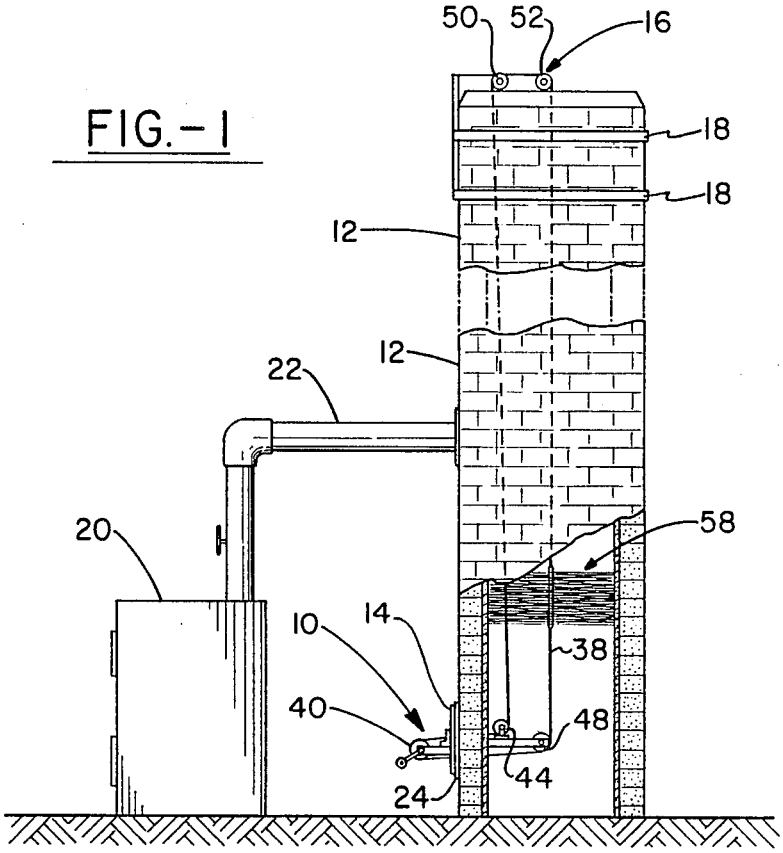
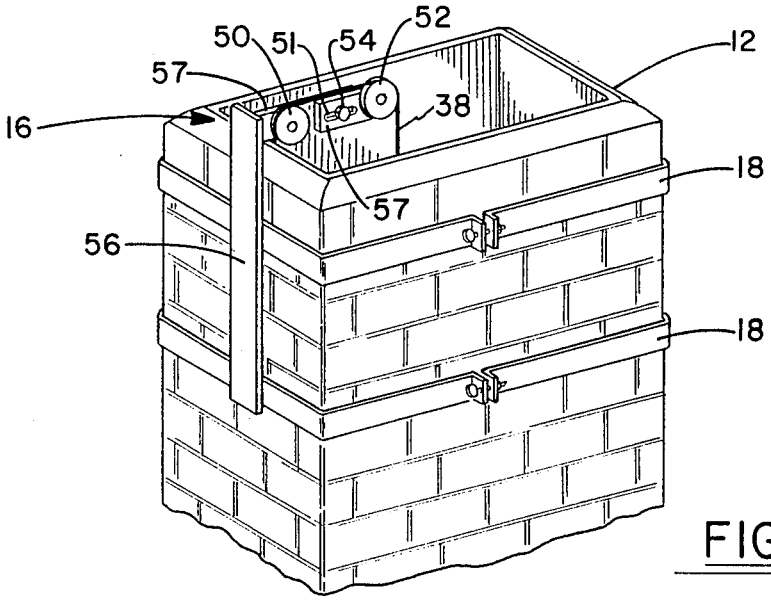
FIG.-3

CHIMNEY CLEANING DEVICE

TECHNICAL FIELD

This invention relates to the cleaning of chimney interiors and to the removal of dirt therefrom. More particularly, this invention relates to a device that is permanently installed in a chimney for cleaning flues, especially for removing combustible dirt therefrom, thus reducing the risk of fire. Specifically, this invention relates to a cleaning brush connected to a cable mounted on a permanently installed pulley system that allows the brush to be passed up and down in the chimney flue, thereby cleaning the chimney.

BACKGROUND OF THE INVENTION

While the installation of wood and coal burning stoves, furnaces, and fireplaces has long provided heat for homes, their use was largely discontinued in most homes in favor of other heating means. Recently, however, as a result of the shortage and high cost of alternate fuels such as natural gas, oil, and the like, such devices have again become relatively popular. In addition, wood burning fireplaces, although infrequently relied upon for their heating ability, have become prized for their aesthetics, and are widely used for that reason. A major disadvantage of such appliances, however, is their unfortunate tendency to create impartially burned by-products, including soot, creosote, and the like, which tend to accumulate on the interior of the flues used to dispose of the gases created in the burning process. Over a period of time, the deposited layer of such materials in the flues becomes quite thick, and it can lead to disasterous fires which not only damage the chimney flues in which they take place, but can actually result in destruction of the house in which the flues are located. Every year many such fires occur, and the cleaning of chimney flues to remove soot and creosote deposits is recommended on a periodic basis, sometimes as often as every month. Individuals engaged in the process of cleaning chimneys are known as "chimney sweeps" , and the process itself if termed "chimney sweeping". Chimney sweeping is carried out in a variety of ways, for example, by the use of rod-mounted brushes which are assembled in successive sections as the brushes are pushed through the chimney to dislodge the deposits described. Other methods, such as for instance, lowering chains or gunny sacks filled with rocks into the chimney, where they are vigorously moved up and down, have also been relied upon, as have other techniques. Such methods, however, have the disadvantage of requiring the chimney sweep to climb to the roof of the dwelling, a dangerous undertaking, particularly in inclement weather. Because of the expense and inconvenience of the cleaning methods described, chimney flues are not cleaned as frequently or as well as they should be to avoid the dangers described. Furthermore, hand cleaning techniques which depend upon the manual skills of the chimney sweep are oftentimes not particularly conducive to thoroughly removing the unwanted deposits.

In addition to the manual methods of chimney cleaning, some semi-automated methods have also been proposed. U.S. Pat. No. 1,777,815, for example, teaches a system and device which can be operated from ground level. The device therein disclosed, however, has certain disadvantage, among which may be mentioned the fact that it cannot be adjusted to accomodate different chimney sizes, and it provides no way in which the moveable carrier chain contemplated by the device can be tightened to provided sufficient tension to allow it to be passed over the pulleys which the device relies upon for its process of cleaning. The device of the patent also depends upon the action of scraping blades, rather than a brush, and the positioning of the carrier chain taught precludes the use of commonly available brushes due to the incompatible positioning of the chain.

DISCLOSURE OF THE INVENTION

In light of the foregoing, therefore, a first aspect of this invention is to provide a chimney cleaning device that can be safely operated from inside the structure in connection with which the chimney being cleaned is used, without any necessity of climbing to the roof of the structure.

A second aspect of the invention is to provide a chimney cleaning device that is semi-automatic, and which does not depend upon the skill of the operator to achieve optimal cleaning.

Another aspect is the provision of permanently installed cleaning equipment that is easy to operate, and therefore encourages the frequent cleaning of chimney flues in which it is installed.

An additional aspect of the invention is to make available a cleaning device that can be adjusted to maintain satisfactory tension in the cleaning tackle.

A further aspect of this invention is to furnish a chimney cleaning device whose components may be readily adapted to accomodate chimneys having different dimensions.

These and other aspects of the invention are provided by a chimney cleaning device which includes:

a chimney base assembly;

a chimney crown assembly;

a double-ended cleaning brush, and a cable, in which said base assembly comprises first and second plates, interconnected and longitudinally adjustable relative to each other, said plates having a first means for attachment to the lower end of the chimney, and said first plate having a crank-driven pulley mounted at its free end, said second plate having a first pulley mounted at its free end, and a second pulley mounted between said first pulley and its other end, said first and second pulleys being adapted for positioning in a chimney flue; wherein said crown assembly comprises third and fourth, spaced apart, pulleys having a second means for attachment to the upper end of a chimney and adapted for positioning over the top of a chimney flue, all said pulleys being vertically mounted in the same vertical plane, and wherein each end of said cable is attached to a separate end of said brush, said brush having bristles adapted to contact the interior periphery of said flue, and wherein further, said cable in conjunction with said brush forms a continuous loop threaded over all of said pulleys with sufficient tension so that said brush can be moved up or down, as desired, in the interior of said flue when said crank is rotated.

The preceding and still other aspects of the invention are provided by a chimney which has incorporated therein the device of the preceding paragraph.

BRIEF DESCRIPTION OF THE DRAWINGS

The invention will be better understood when reference is had to the drawings herein contained, in which like numbers refer to like parts.

FIG. 1 is a side elevation of a furnace and an associated chimney equipped with a cleaning device of the invention.

FIG. 3 is an isometric view of a brush bracket, or chimney crown assembly, of the invention.

BEST MODE FOR CARRYING OUT THE INVENTION

Figures 2, 3A, 4:
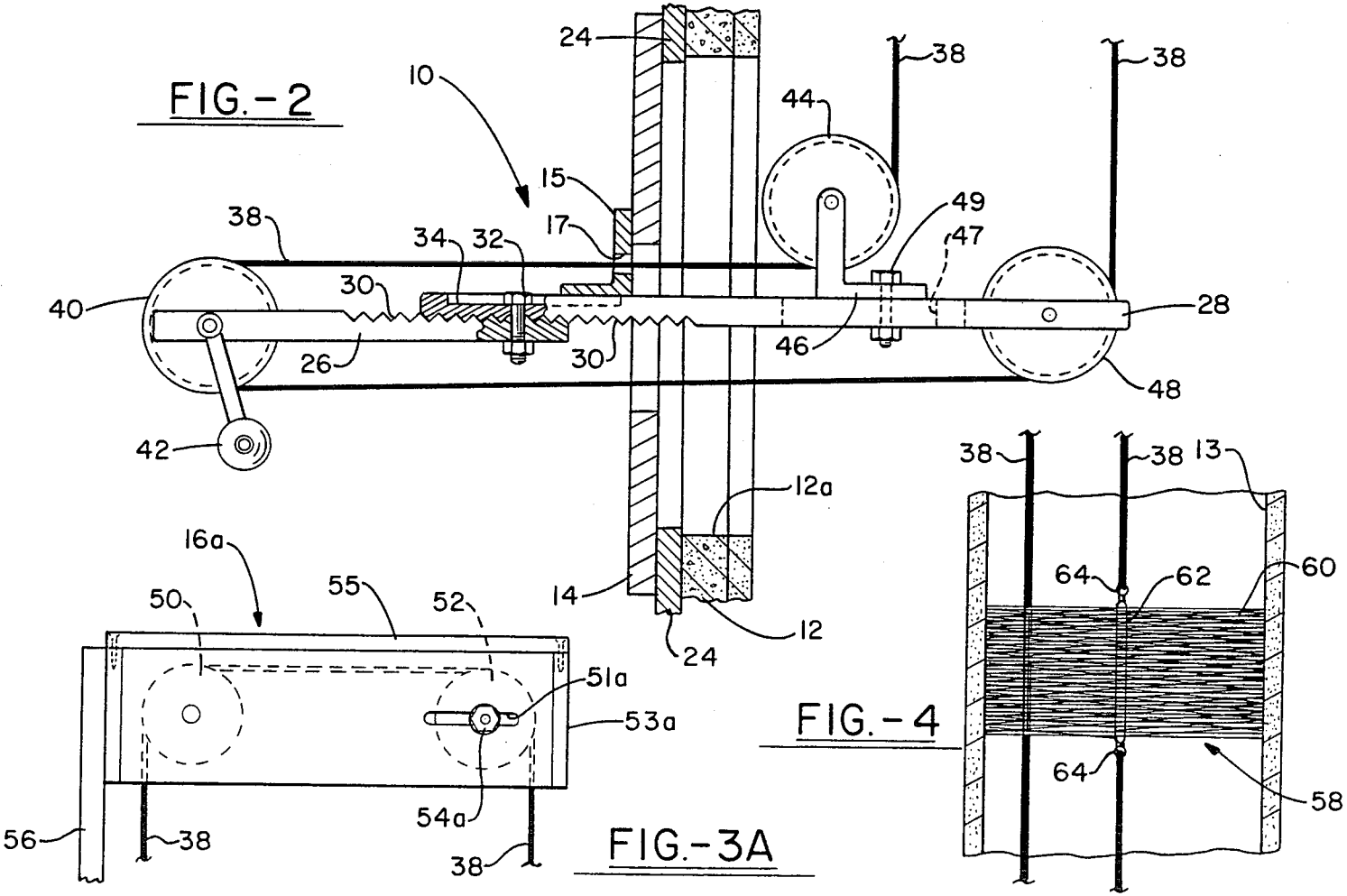
FIG. 2 is a side elevation of a chimney cable control, or base assembly, of the cleaning device of the invention.
FIG. 3A shows an isometric view of a different embodiment of a portion of the crown assembly.
FIG. 4 is a side elevation of a portion of the interior of a chimney with a double-ended cleaning brush of the invention disposed therein.

FIG. 1 illustrates side elevation of a furnace 20 and an associated chimney, generally 12, used in connection therewith. In the Figure, the Furnance 20 is connected to the chimney 12 by furnace pipe 22. The cable control, or base assembly of the invention is shown at the lower end of the chimney structure, generally by the numeral 10, while the brush bracket assembly, or crown assembly, used in connection with the base assembly, is shown generally by the numeral 16. The crown assembly 16 is shown fastened to the chimney by means of clamps 18, while the base assembly is mounted through a flue guard 14, which is itself fastened to the ash door 24, projecting through a hole therein, in the chimney 12. Removal of ashes dislodged in the cleaning process is accomplished through the ash door 24.

The size of some of the assemblies and other components of the chimney cleaning device shown in FIG. 1, and in certain other of the figures, has been deliberately enlarged out of proportion to the rest of the details of the figures to more clearly illustrate their details and operating concepts. The actual size of the components of the chimney cleaning device may be varied within relatively broad limits, and will obviously depend upon the dimension of the chimney flue, those of the chimney structure itself, and other associated factors. While the chimney cleaning device is illustrated in connection with a furnace, the cleaning process which it makes possible is equally applicable in the case of a stove or fireplace, irrespective of whether the combustion chamber is designed for wood, coal, or other combustibles. In the Figure, the base assembly 10 is shown mounted on a plate, or "flue guard" 14, the latter being fastened to the ash door 24 directly over a hole in the chimney structure 12. However, the base assembly might also be mounted through a separate hole in the chimney. Furthermore, FIG. 1 is intended to represent a chimney structure comprising a clay flue liner, the outside of which is lined with masonary of some suitable type, e.g., brick or stone. The chimney cleaning device is also suited for use with other combustion gas ducting, as for instance, with metal flues.

FIG. 2 shows a more detailed view of the base assembly 10 of the invention. Illustrated in the Figure are a lower plate 26 adjacently connected to an upper plate 28 by a clamp screw 32 passing through the inter-connected ends of the plates. The length of the inter-connected plates 26 and 28 may be adjusted by loosening clamp screw 32 and moving plate 26 so that the screw positioned therethrough moves along adjustment slot 34, permitting the rack teeth 30 provided on the adjacent surfaces of each of the plates to be repositioned relative to each other. Once the desired length has been thus achieved, the clamp screw 32 is retightened, preventing further longitudinal movement of the plates relative to each other by virtue of the intermeshing of the rack teeth. Upper plate 28 is secured to flue guard 14 by means of door bracket 15 which is connected by fasteners to both the plate and the flue guard. The lower plate 26 has a pulley 40, driven by crank 42, mounted at its free end, while upper plate 28 has a middle base pulley 48 mounted at its free end, and an outer base pulley 44 between its free end and its other, interconnected end. The outer base pulley 44 is attached to the upper plate 28 by means of pulley bracket 46, connected to the upper plate by means of bracket adjustment screws 49. As will be seen from the Figure, the outer base pulley 44 is disposed above the upper plate, and the distance between the axes between outer base pulley 44 and middle base pulley 48 may be desirably adjusted by loosening bracket adjustment screws 49 and moving the same along bracket adjustment slots 47. Such adjustment is sometimes desirable to accomodate chimney flues of varying dimensions. A cable 38 passes around the pulleys, as shown, which can be moved back or forth simply by rotating crank 42. Flue guard 14 is attached either to an ash door 24 by means of fasteners not shown, or to the chimney structure directly. The flue guard 14, and associated door bracket 15 have a hole 17 disposed therein to accomodate passage of cable 38. The adjustment provided by adjustment slot 34, previously described, allows proper tension to be maintained in cable 38 so that the cable may be properly moved by crank-driven pulley 40. Such adjustment is necessary if the cable loosens, or when the chimney cleaning device is to be re-positioned in a way requiring modifying adjustment. The base assembly 10 may be disposed at any convenient location in the chimney structure; however, it will normally be located at the lower end of the chimney at a height at which it can be conveniently operated.

The dimensions of the components of base assembly 10 can be selected within a broad range, and will depend upon the dimensions of the chimney structure and the flue in connection with which the assembly is used. The components can be relatively small, as in the case where they are used with a smaller flue, for instance, one about 12 inches square. In the latter case, while other dimensions may be selected, components which have been found effective include those where the lower plate 26 is about 6 inches long, $\frac{3}{8}$ inch thick, and $1\frac{1}{4}$ inch wide; the upper plate is about 10 inches long, $\frac{3}{8}$ inch thick, and $1\frac{1}{4}$ inch wide, and the pulleys are about $1\frac{1}{2}$ inch in diameter, the balance of the parts of the base assembly having dimensions proportional to those described. Preferably, the grooves in the pulleys through which the cable 38 passes are sufficiently deep so that even in the event the pulley should become "frozen" and unrotatable, the cable will continue to slip through the grooves as the cleaning operation is performed.

FIG. 3 illustrates an isometric view of a brush bracket, or chimney crown assembly, indicated generally by the numeral 16. The crown assembly 16 comprises an outer crown pulley 50, and a middle crown pulley 52, spaced apart from each other, preferably with their axes disposed in the same horizontal plane. Outer crown pulley 50 and middle crown 52 are mounted to a pulley bracket, comprising a bar assembly including two interconnected bars 57 that may be moved relative to each other by loosening bracket adjustment screw 54 and lengthening or shortening the assembly by means of bracket adjustment slot 51. Such adjustment is sometimes desirable when the crown assembly is used with chimney flues of varying dimensions. The pulley bracket is connected to a mounting shaft or plate 56, which in turn is fastened to the chimney structure by means of clamps 18. Cable 38 passes over the pulleys and downward into the flue, as shown. While the Figure illustrates a rectangular chimney flue, other shapes, as for example, round, rectangular, etc., may also be employed. The mounting shown, presupposes location of the middle crown pulley 52 and outer crown pulley 50 over the chimney 12, and when so mounted, the height of the pulleys over the top of the chimney may be varied adjacent the top of the chimney as desired. All the pulleys employed in the chimney cleaning device of the invention are mounted vertically as shown, and will substantially be in the same vertical plane.

The pulley bracket is shown in the Figure attached to chimney 12 by means of mounting shaft 56 and clamps 18. The method of mounting is relatively unimportant, however, and may be modified in any of various ways well known in the art. As in the case of the base assembly, the dimension of the components of the crown assembly 16 may be altered to suit the requirements of the chimney structure in connection with which it is used.

FIG. 3A shows an isometric view of a somewhat different embodiment, generally **16*a*, of a portion of the crown assembly of the invention. In FIG. 3A there is shown a pulley bracket enclosed on all four sides 53*a* adapted to receive a bracket cover 55 which protects the outer crown pulley 50 and middle crown pulley 52 from the elements. A portion of the mounting plate 56 is shown, with other aspects of the mounting system being similar to those shown in FIG. 3. Similar to the adjustment means shown in FIG. 3, the axes of outer crown pulley 50 and middle crown pulley 52 may be altered by moving the pulley shaft 54*a* in bracket adjustment slot 51*a*, and securing the shaft in its new position in any of the ways well known in the art. Component dimensions of the crown assembly 16a** may be selected to meet the requirements of use; however, in the case of a one foot square flue, dimensions including an enclosed pulley bracket $3\frac{1}{2}$ inches long, by 1 inch high and 1 inch wide, with associated pulleys being $\frac{7}{8}$ inch in diameter by $\frac{3}{8}$ wide, are typical. Although other materials may be used for fabricating the pulleys of the invention, including steel and other metals, aluminum is particularly suited to the purposes of the invention.

FIG. 4 is a side view of the interior of a chimney 13 with a double-ended cleaning brush 58 disposed therein. As shown, the brush 58 comprises a core 62 from which a plurality of bristles 60 extend. The brush is attached to cable 38 on each of its two ends by means of brush adapters 64 which are fastened to the core by threaded interconnection, and to the cable by passing the latter through a hole in the adapters. The core 62, bristles 60, and adapters 64 are made from a heat resistant material, such as metal, usually from steel. The bristles 60 are fabricated long enough to scrape all sides of the chimney flue in which the brush 58 is disposed, when the brush is located substantially in the middle of the chimney flue 13. The transverse shape of the brush 58 will be selected to conform with the shape of the chimney flue 13 to be cleaned, that is a round brush will be used in a round chimney flue, a square brush in a square flue, etc. Since chimney sweeping brushes of the type used with manual chimney sweeping methods are provided with threaded ends, such brushes can advantageously be used with the chimney cleaning device of the invention by use of the adapters 64 described.

Again referring to FIG. 1, cable 38 passes from the crank-driven pulley 40 to the middle base pulley 48, and from there to middle crown pulley 52, proceeding to outer crown pulley 50, then to outer base pulley 44, and back to the crank pulley 40. As will be noted from the Figure, middle base pulley 48 and middle crown pulley 52 are located in a vertical line with each other, approximately in the middle of the chimney 12, while outer base pulley 44 and outer crown pulley 50 are also located in a vertical line with each other, near the edge of the chimney.

The cable employed in connection with the chimney cleaning device of the invention is made from metal, braided or a monofilament, and is commonly $\frac{1}{8}$ to $\frac{1}{4}$ inch in diameter. As is apparent from the Figure, rotation of the crank 42 causes the cable loop to move either clockwise or counterclockwise, depending on the direction of rotation, resulting in either an upward or downward movement of cleaning brush 58.

While in accordance with the patent statutes, a preferred embodiment and best mode has been presented, the scope of the invention is not limited thereto but rather is measured by the scope of the attached claims.

What is claimed is:

1. A chimney cleaning device which includes:

a chimney base assembly;

a chimney crown assembly;

a double-ended cleaning brush, and a cable, in which said base assembly comprises first and second plates, interconnected and longitudinally adjustable relative to each other, said second plate having a first means for attachment to the lower end of a chimney, and said first plate having a crankdriven pulley mounted at its free end, said second plate having a first pulley mounted at its free end, and a second pulley mounted between said first pulley and its other end, said first and second pulleys being adapted for positioning in a chimney flue; wherein said crown assembly comprises third and fourth, spaced apart, pulleys having a second means for attachment to the upper end of a chimney and adapted for positioning adjacent to the top of a chimney flue, all said pulleys being vertically mounted in the same vertical plane, and wherein each end of said cable is attached to a separate end of said brush, said brush having bristles adapted to contact the interior periphery of said flue, and wherein further, said cable in conjunction with said brush forms a continuous loop threaded over all of said pulleys with sufficient tension so that said brush can be moved up or down, as desired, in the interior of said flue, when said crank is rotated.

2. A chimney cleaning device according to claim 1 in which the interconnection between said plates comprises intermeshing rack teeth disposed on adjacent overlapping surfaces of the interconnected ends of said plates, said ends being adjustably fixed to each other by a fastener extending through a longitudinal slot in one of said plates, and a hole in the other.

3. A chimney cleaning device according to claim 2 in which said second plate is disposed over said first plate, and said first means comprises a bracket holding said second plate to said chimney.

4. A chimney cleaning device according to claim 3 in which the axes of said third and fourth pulley are located in substantially the same horizontal plane, and the distance between such axes is adjustable.

5. A chimney cleaning device according to claim 4 in which said second pulley is mounted above said second plate on a bracket attached to, and also disposed above said second plate, and wherein the distance between the axes of said first and second pulleys is adjustable.

6. A chimney cleaning device according to claim 4 in which said third and fourth pulleys are journaled in a pulley bracket enclosed on all four sides and having a covered top and connected to a mounting plate adapted for attachment to the top of a chimney.

7. A chimney cleaning device according to claim 3 in which said bracket is attached to a metal plate adapted for fastening over a hole in a chimney through which said second plate extends.

8. A chimney cleaning device according to claim 3 in which said bracket is mounted on a flue guard plate before being attached to said chimney.

9. A device according to claim 1 in which said cable is attached to the ends of said brush by adapters, one end of each of which is threadably connected to an end of said brush, and the other end of each of which is fastened to said cable by passing said cable through a hole in the other end of said adapters.

10. A chimney which has incorporated therein a chimney cleaning device which includes:

a chimney base assembly;

a chimney crown assembly;

a double-ended cleaning brush, and a cable, in which said base assembly comprises first and second plates, interconnected and longitudinally adjustable relative to each other, said second plate having a first means for attachment to the lower end of a chimney, and said first plate having a crank-driven pulley mounted at its free end, said second plate having a first pulley mounted at its free end, and a second pulley mounted between said first pulley at its other end, said first and second pulleys being adapted for positioning in a chimney flue; wherein said crown assembly comprises third and fourth, spaced apart, pulleys having a second means for attachment to the upper end of a chimney and adapted for positioning adjacent to the top of a chimney flue, all said pulleys being vertically mounted in the same vertical plane, and wherein each end of said cable is attached to a separate end of said brush, said brush having bristles adapted to contact the interior periphery of said flue, and wherein further, said cable in conjunction with said brush forms a continuous loop threaded over all of said pulleys with sufficient tension so that said brush can be moved up or down, as desired, in the interior of said flue, when said crank is rotated.

* * * * *